US007959475B2

(12) United States Patent
Wellmann

(10) Patent No.: US 7,959,475 B2
(45) Date of Patent: Jun. 14, 2011

(54) CABLE-ARRAYING FOR CONNECTORS

(75) Inventor: Christa Wellmann, Stemwede (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 12/690,345

(22) Filed: Jan. 20, 2010

(65) Prior Publication Data

US 2010/0216353 A1 Aug. 26, 2010

(30) Foreign Application Priority Data

Feb. 25, 2009 (DE) ..... 10 2009 010 492

(51) Int. Cl.
*H01R 13/40* (2006.01)

(52) U.S. Cl. ..... 439/752.5

(58) Field of Classification Search ..... 439/733.1, 439/750–752, 752.5
See application file for complete search history.

(56) References Cited

U.S. PATENT DOCUMENTS

| | | | | |
|---|---|---|---|---|
| 5,871,373 | A * | 2/1999 | Pacini et al. | 439/587 |
| 6,994,598 | B2 * | 2/2006 | Holmes et al. | 439/752.5 |
| 7,371,124 | B2 * | 5/2008 | Khemakhem et al. | 439/668 |
| 7,780,486 | B2 * | 8/2010 | Yavari et al. | 439/752.5 |

FOREIGN PATENT DOCUMENTS

DE 100 19 294 10/2001

* cited by examiner

*Primary Examiner* — Khiem Nguyen
(74) *Attorney, Agent, or Firm* — Hayes Soloway P.C.

(57) ABSTRACT

In order to provide a simple option for connecting electric conductors (7) of an electric cable (6) to a connector (1) and, in particular, to always ensured the correct length of the conductors with electric contacts (28) attached thereto, the invention proposes a so-called cable manager (10) with a measuring pin (12), on which the individual electric conductors (7) can be measured and correspondingly capped such that the desired and exact length of the electric conductors (7) to be inserted into the connector is always ensured after the attachment of the corresponding electric contacts (28).

6 Claims, 5 Drawing Sheets

CABLE-ARRAYING FOR CONNECTORS

BACKGROUND OF THE INVENTION

1. Field of the Invention

The invention pertains to a connector with a cable-arraying insert for realizing a simplified arrangement of electric conductors within a connector housing and for ensuring a sufficient cable length of the electric conductors with electric contacts to be attached thereto.

A cable manager of this type is advantageous for arranging and fixing electric conductors that need to be inserted into a connector and feature attached electric contacts in chambers provided for this purpose in a precisely fitted fashion.

2. Description of the Related Art

DE 100 19 294 discloses a multipolar circular connector with several contact carrier parts that are nested into one another, wherein axially aligned clamp mountings are provided within these contact carrier parts and electric contacts can be fixed in said clamp mountings.

In the vast majority of conventional circular connectors, the electric conductors or cables with the electric contacts need to be more or less cut to a certain length and stripped, but this is not always ensured during an on-site assembly.

Incorrect connections between the contacts and the electric conductors and their installation in the connector can easily occur, particularly during an on-site assembly.

SUMMARY OF THE INVENTION

Consequently, the invention is based on the objective of realizing the assembly of electric conductors and the corresponding electric contacts that are intended for use in a connector housing in the most simple and effective fashion possible, particularly with consideration of an on-site or field assembly.

This objective is attained in that a cable-arraying insert in the form of a cable manager is provided within the connector housing in order to accommodate the electric conductors in the form of an array, in that an axially aligned measuring pin is integrally moulded onto the cable manager, and in that a contact carrier for the electric conductors with electric contacts attached thereto is provided within the connector housing, wherein at least one electric conductor is arranged in the center of the contact carrier that consists of two shells.

Different cable managers for accommodating electric conductors or cables connected to electric contacts in the form of an array and for realizing their arrangement in connectors are available.

In prefabricated or ready-made cables, the electric conductors and the electric contacts attached thereto always have the correct length and can be exactly installed in the connector housing.

In order to provide a similar and simple option for an on-site assembly, the invention proposes a so-called cable manager that advantageously features a scale or measuring pin, on which the individual electric conductors can be measured and correspondingly capped such that the desired and exact length of the electric conductors to be inserted into the connector is always ensured after the attachment of the corresponding electric contacts.

For this purpose, a so-called clamping screw and a seal of the connector are initially pushed onto a stripped cable with exposed electric conductors and the individual protruding conductors are subsequently placed into corresponding recesses that are axially arranged on the outer surface of the disk-shaped cable manager.

In this case, projections are provided on a peripheral collar of the cable manager in the region of these recesses such that the conductors inserted into these recesses cannot readily slide out.

After the partial insertion of the cable manager into the seal, a hat-shaped, electrically conductive shielding element is attached and fixed on a pin on the seal with the aid of a recess.

In addition, an axially aligned measuring pin is integrally moulded onto the cable manager, wherein the length of this measuring pin represents the exact conductor length when the cable manager is correctly positioned in and on the seal. Once the electric conductors have been cut to the corresponding length, the measuring pin can also be cut off or broken off.

The shortened electric conductors are now connected to corresponding electric contacts and inserted into—preferably color-coded—half-open recesses of a contact carrier to be attached to the shielding element. In this case, the contact carrier advantageously consists of two shells that are connected to one another by means of an integral hinge. Consequently, at least one of the electric conductors can also be inserted into the center of the contact carrier while the remaining electric conductors are inserted into the recesses that are axially distributed over the circumference and clamped therein.

Subsequently, the connector sleeve is pushed onto the above-described assembled parts and fixed with the clamping screw.

BRIEF DESCRIPTION OF THE DRAWINGS

One embodiment of the invention is illustrated in the figures and described in greater detail below in which.

DESCRIPTION OF THE PREFERRED EMBODIMENTS

Figure 1:
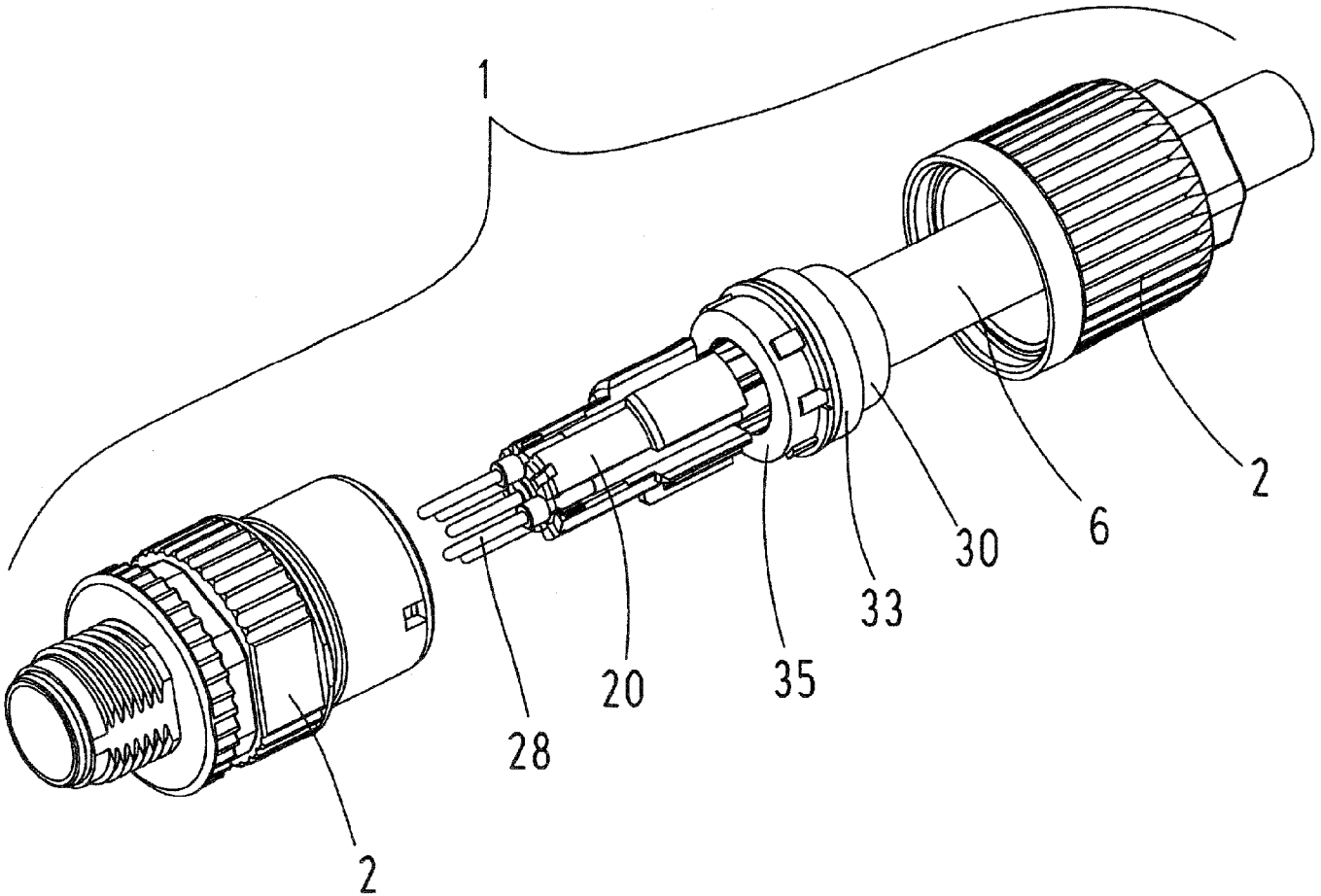
FIG. 1 is an exploded view of a circular connector.

In order to provide a general overview, FIG. 1 shows an exploded view of all relevant parts of the circular connector 1 and an electric cable 6 that comprises several electric conductors 7.

According to this figure, the circular connector 1 consists of a connector sleeve 2 that mutually fixes the internal components with the aid of a clamping screw 4.

These components include a contact carrier 20 that accommodates the ends of the electric conductors 7 that are provided with attached electric contacts 28. In addition, a so-called cable manager 10 is provided and partially arranged within an electrically conductive shielding element 35, wherein said shielding element is fixed on a seal 30, over which the braided shielding 8 of the electric cable 6 is placed.

The clamping screw 4 acts upon the seal 30 when the screw connection with the connector sleeve 2 is produced such that the electric cable 6 is secured against tensile stresses and the interior of the connector is protected from environmental influences.

Figure 2A:
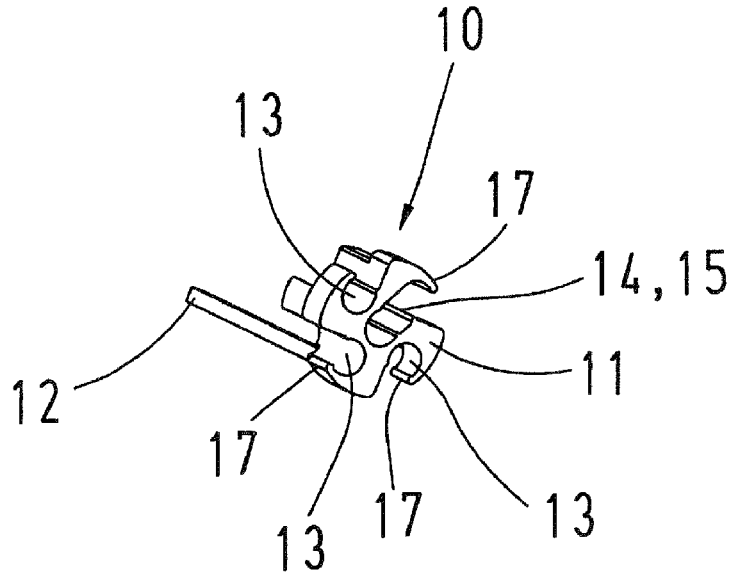
FIG. 2*a* is a perspective representation of a cable manager.
Figure 2B:
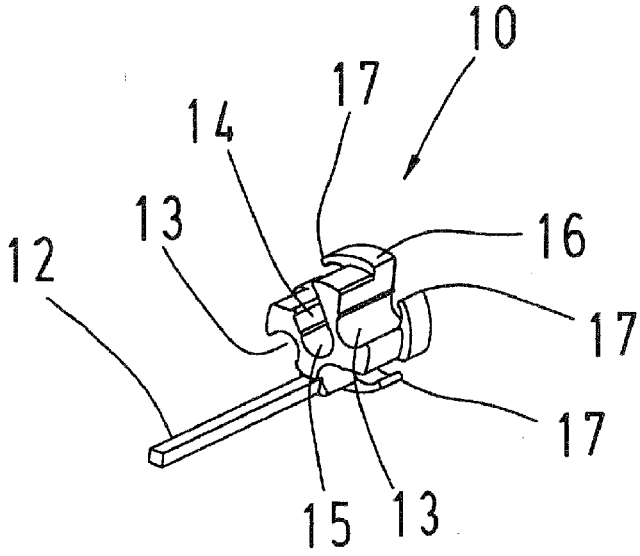
FIG. 2*b* is a perspective representation of the cable manager from a different viewing direction.

FIG. 2*a* and FIG. 2*b* show two different views of the cable manager 10.

The cable manager consists of an injection-moulded plastic part and basically represents a disk-shaped round part 11 to be inserted into the connector sleeve 2.

The outer side of the cable manager 10 features several axially aligned, half-open chambers 13 that are distributed over the circumference and serve for accommodating the electric conductors 7. In addition, an elongate opening 14 is provided that is directed into the center and accommodates a central electric conductor in the central opening 15, as well as an outer electric conductor, such that a total of five electric conductors 7 are bundled.

In order to accommodate the electric conductors 7 in a self-retaining fashion, an overhang 17 is integrally moulded onto each of the half-open chambers 13 and creates a narrowing of the chambers in a certain area, wherein said overhang forms part of a collar 16 that surrounds the cable manager 10.

The cable manager 10 furthermore features an axially aligned measuring pin 12, wherein all electric conductors 7 guided in the cable manager 10 need to be shortened to the length of this measuring pin during the assembly of the connector. After the shortening of the conductors, the measuring pin 12 can be cut off or broken off at a predetermined breaking point.

Figure 3:
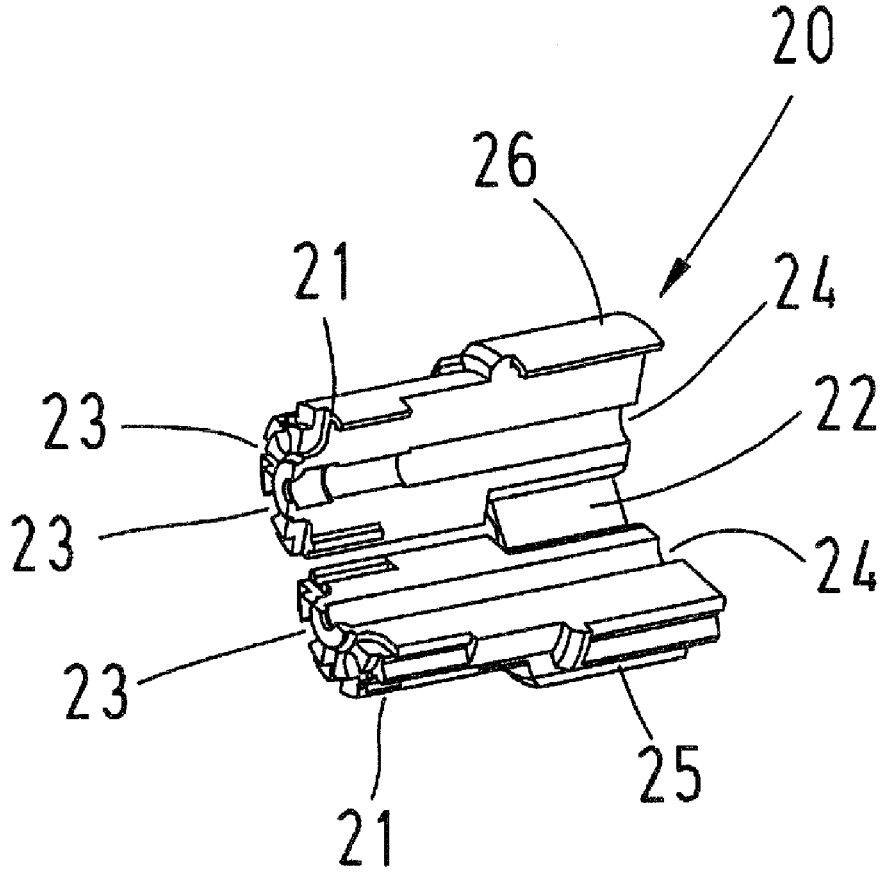
FIG. 3 is a perspective representation of a contact carrier.

FIG. 3 shows the contact carrier 20 that is composed of two shells 21 in order to ultimately also accommodate the central electric contact.

The two shells 21 are connected to one another in a pivoted fashion by means of an integral hinge 22.

A half-open central chamber 24 for the central electric contact 28 and the electric conductor 7 attached thereto is respectively formed in the interior of the shells 21. A combination of a snap-on hook 25 and an undercut 26, on which said hook engages, is provided in order to snap together the two shells 21.

Figure 4:
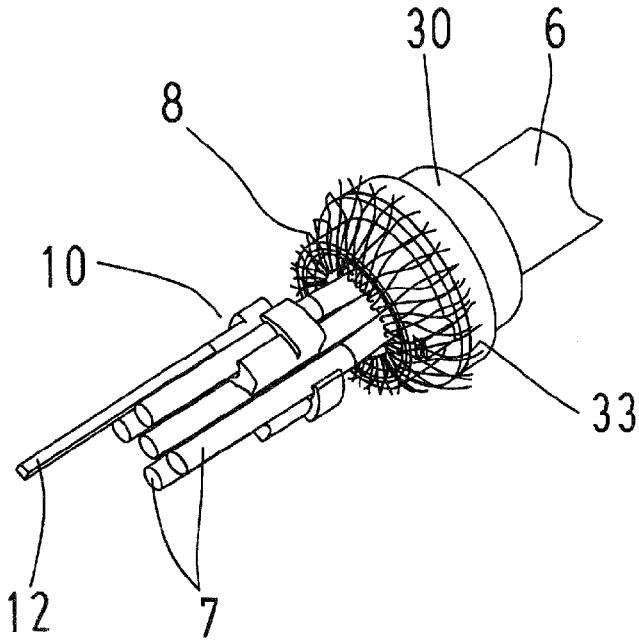
FIG. 4 is a cable manager that is fitted with electric conductors.

FIG. 4 shows the electric cable 6, wherein a clamping screw 4 or even a coupling ring required for the circular connector 1 is already pushed onto said cable.

This figure also shows a seal 30 with a sliding ring 33, as well as several electric conductors 7 that are already inserted into the cable manager 10, namely into the half-open chambers 13. The braided shielding 8 provided for shielding the cable 6 is already fanned out and folded back such that it extends over the seal 30.

Figure 5:
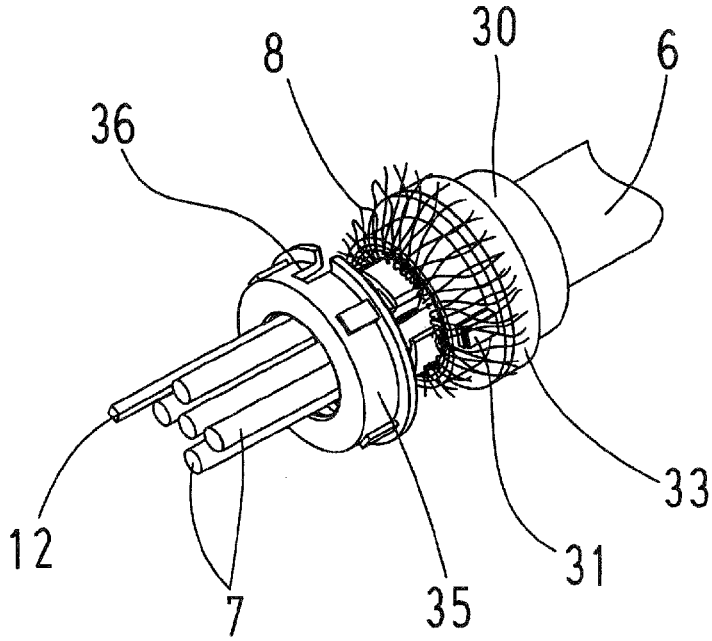
FIG. 5 is an electrically conductive shielding element to be pushed onto the cable manager.

Subsequently, the cable manager 10 is at least partially pushed into a corresponding recess in the seal 30 such that the cable manager 10 already is loosely fixed on the braided shielding 8. Subsequently, the hat-shaped shielding element 35 is pushed onto the cable manager 10 and onto the braided shielding 8 on the seal 30 and connected to a latching lug 31 on the seal 30 in a non-rotatable fashion with the aid of a suitable recess 36. (FIG. 5).

The shielding effect of the braided shielding 8 is transferred to the electrically conductive shielding element 35 and subsequently to the electrically conductive connector sleeve 2.

Consequently, the seal, the conductor guide element and the shielding element are interconnected into one part together with the electric conductors.

The electric conductors 7 are now shortened to the length of the measuring pin 12 on the cable manager 10 and the measuring pin 12 is subsequently cut off or broken off at a predetermined breaking point.

The electric conductors 7 are then connected to corresponding electric contacts 28 by means of a crimping process.

It is therefore ensured that all electric conductors with the attached electric contacts have the exact length for the circular connector.

Figure 6:
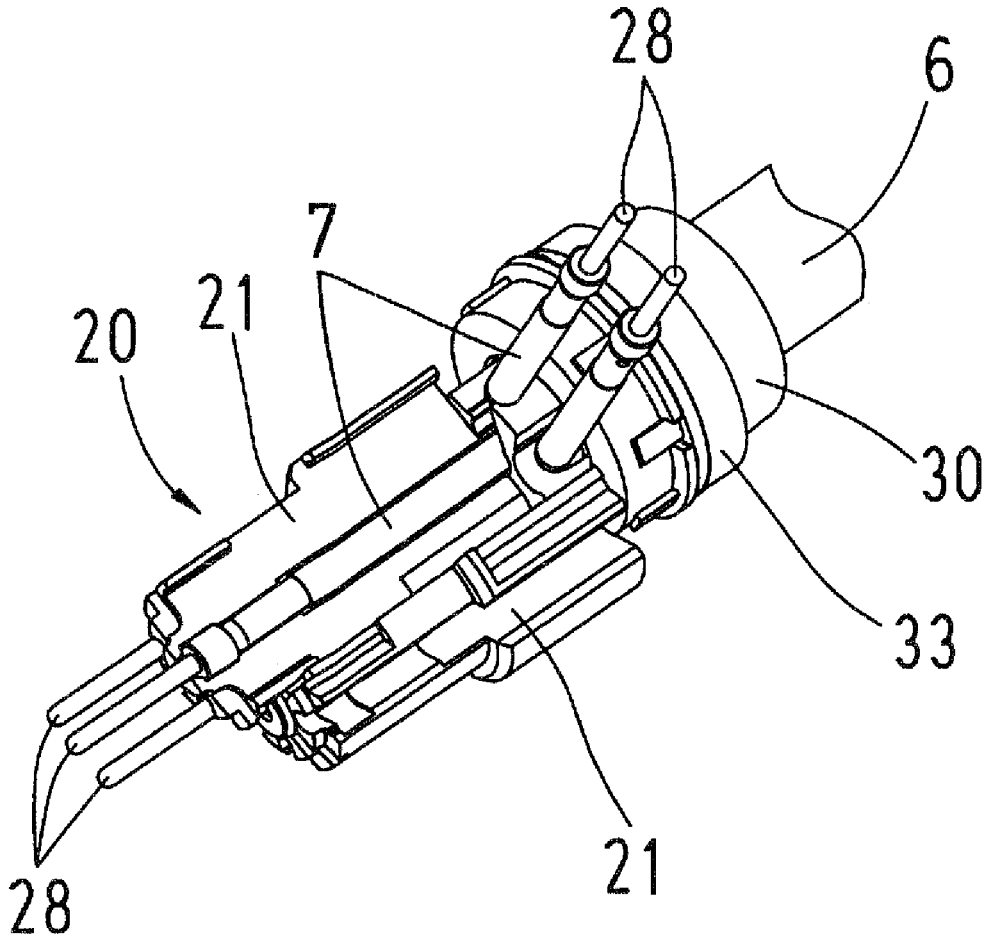
FIG. 6 shows electric conductors with electric contacts that respectively are inserted or still need to be inserted into the contact carrier.

According to FIG. 6, the electric contacts 28 are inserted into the contact carrier 20 together with the electric conductors 7. In this case, the outer conductors are initially bent outward at the cable manager 10 such that the central conductor can be inserted into the opened shells 21 of the contact carrier and fixed in the central chamber 24 by closing and snapping together the shells.

This can be realized by moving the contact carrier 20 close to the cable manager 10. Subsequently, the bent conductors 7 are inserted into the outwardly directed half-open chambers 24 and slightly clamped therein.

In this case, the chambers 24 may be color-coded in accordance with the cable colors in order to simplify the assembly.

According to above-described FIG. 1, the connector sleeve 2 can now be pushed onto the assembled parts, namely the seal 30, the cable manager 10, the shielding element 35, the contact carrier 20 and the electric contacts 28 with the conductors 7, and screwed together into a functional circular connector 1 with the aid of the clamping screw 4.

What is claimed is:

1. A connector with a cable-arraying insert for realizing a simplified arrangement of electric conductors within a connector housing and for ensuring a sufficient cable length of the electric conductors with electric contacts to be attached thereto, comprises a cable-arraying insert in the form of a cable manager is provided within the connector housing in order to accommodate the electric conductors in the form of an array, an axially aligned measuring pin is integrally moulded onto the cable manager, and a contact carrier for the electric conductors with electric contacts attached thereto is provided within the connector housing, wherein at least one electric conductor is arranged in the center of the contact carrier that consists of two shells.

2. The connector according to claim 1, wherein the shells of the contact carrier feature several half-open chambers on their outer side in order to accommodate electric conductors provided with electric contacts in a self-retaining fashion.

3. The connector according to claim 1, wherein a chamber for a centrally arranged electric contact is provided within the shells in the center of the contact carrier.

4. The connector according to claim 1, wherein the shells of the contact carrier can be radially pivoted relative to one another with the aid of an integral hinge and snapped together.

5. The connector according to claim 1, wherein the cable manager features axially arranged half-open chambers on the outer side of its cylindrical housing, as well as a central opening.

6. The connector according to claim 5, wherein an axially aligned measuring pin is integrally moulded onto the cable manager and can be removed after the electric conductors have been cut to the corresponding length.

* * * * *